US005174003A

United States Patent [19]

Bitzer

[11] Patent Number: 5,174,003

[45] Date of Patent: Dec. 29, 1992

[54] GUIDING ROLLER FOR THREADS

[75] Inventor: Eugen Bitzer, Schorndorf, Fed. Rep. of Germany

[73] Assignee: Terrot Strickmaschinen GmbH, Stuttgart, Fed. Rep. of Germany

[21] Appl. No.: 709,705

[22] Filed: Jun. 3, 1991

[30] Foreign Application Priority Data

Jun. 9, 1990 [DE] Fed. Rep. of Germany ..... 4018497

[51] Int. Cl.[5] ..... B21B 1/08; B21B 27/02; B21B 31/08

[52] U.S. Cl. ..... 29/122; 57/352; 226/194; 384/418

[58] Field of Search ..... 29/116.1, 122; 384/244, 384/245, 246, 417, 418; 57/352; 242/157 R; 226/194; 66/125 R, 218

[56] References Cited

U.S. PATENT DOCUMENTS

| | | | |
|---|---|---|---|
| 321,075 | 6/1885 | Alden | 29/122 X |
| 352,351 | 11/1886 | Pope | 29/116.1 X |
| 423,823 | 3/1890 | Shaw | 29/116.1 X |
| 640,009 | 12/1899 | Mittinger, Jr. | 384/417 |
| 764,584 | 7/1904 | Haserick | 384/417 |
| 822,517 | 6/1906 | Fleming | 29/122 |
| 1,346,400 | 7/1920 | Dover | 384/244 X |
| 1,882,480 | 10/1932 | Brueshaber | 29/116.1 |
| 2,003,255 | 5/1935 | Duff | 384/418 X |
| 2,158,865 | 5/1939 | Sammon | 29/116.1 X |
| 2,547,975 | 4/1951 | Robertson | 29/116.1 X |
| 3,019,645 | 2/1962 | Lake | 29/122 X |
| 3,035,874 | 5/1962 | Ferris et al. | 384/418 |
| 3,651,911 | 3/1972 | Kornylak | 29/122 X |
| 4,079,916 | 3/1978 | Einhorn et al. | 384/417 X |
| 4,197,624 | 4/1980 | Lass | 29/122 X |

FOREIGN PATENT DOCUMENTS

| | | | |
|---|---|---|---|
| 415612 | 10/1924 | Fed. Rep. of Germany | 242/129.51 |
| 2105284 | 8/1971 | Fed. Rep. of Germany | 384/418 |
| 0152236 | 11/1955 | Sweden | 29/116.1 |
| 205902 | 10/1923 | United Kingdom | 242/129.51 |

*Primary Examiner*—Timothy V. Eley
*Assistant Examiner*—C. Richard Martin
*Attorney, Agent, or Firm*—Shenier & O'Connor

[57] ABSTRACT

A guiding roller for threads, in particular elastomeric threads, on textile machines, in particular knitting machines, includes a shaft which carries the guiding roller and is supported at its ends on both sides of the guiding roller in bearing recesses. The bearing recesses are designed so as to go right through, the ends of the shaft taper towards the bearing recesses, and these ends penetrate the bearing recesses with play and protrude beyond these recesses.

8 Claims, 1 Drawing Sheet

GUIDING ROLLER FOR THREADS

The invention relates to a guiding roller for threads, in particular elastomeric threads, on textile machines, in particular knitting machines, with a shaft which carries the guiding roller and is rotatingly supported at its ends on both sides of the guiding roller in bearing recesses of holders.

In known guiding rollers of this kind, the circular-cylindrical ends of the shaft are supported practically without play in the bearing recesses. Consequently, bits of fiber in the form of fluff or the like which have unavoidably become detached collect in the region of the shaft between holder and guiding roller. As a result of this, the roller becomes obstructed in its running and finally comes to a standstill. When an incoming thread then slides further over the guiding roller, it cuts into the latter. Once the guiding roller comes to a standstill and even more so when the thread cuts into the roller, undesirably high thread run-in tensions occur on a textile machine and cause deterioration in the quality of the product made by the textile machine.

The difficulties referred to hereinabove occur particularly when elastomeric synthetic threads, for example, lycra threads (registered trademark of the Du Pont company) are used, for example, when such threads are processed by a knitting machine on which an irregular stitch structure can occur.

The object of the invention is to so improve a generic guiding roller that it does not become jammed or come to a standstill during its rotation even if there is a considerable amount of fibrous fluff.

This object is accomplished in accordance with the invention by the bearing recesses in the holders being designed so as to go right through, by the ends of the shaft tapering towards the bearing recesses, and by the tapering ends of the shaft penetrating the bearing recesses with play and protruding beyond these recesses.

This results in the advantage that owing to the play of the shaft in the bearing recess there is always an opening through which the detached bits of fiber accumulated by the rotating shaft and other dust particles can be hurled away. The roller is thereby prevented from jamming.

Figure 1:
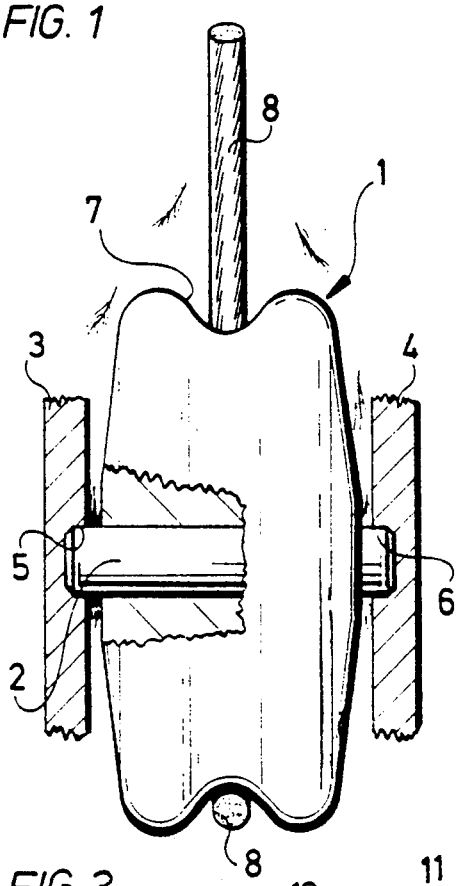
Figure 2:
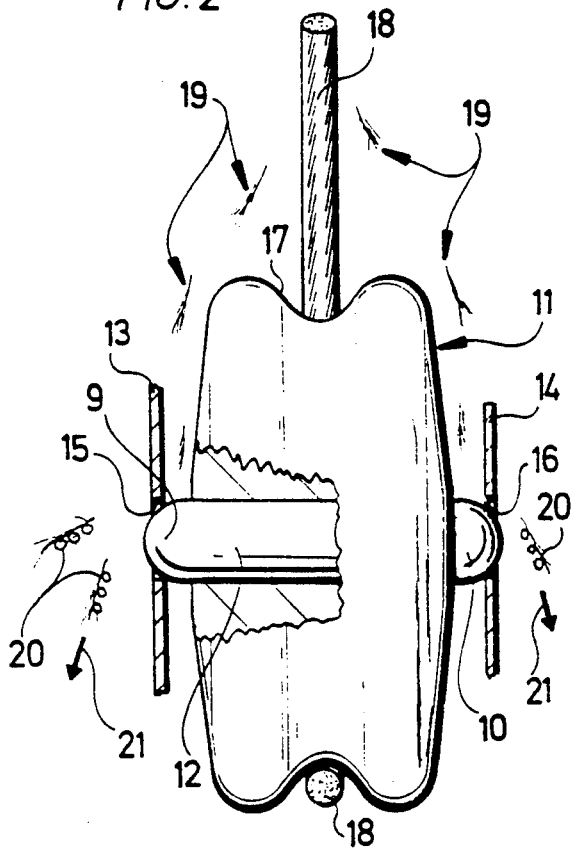
Figure 3:
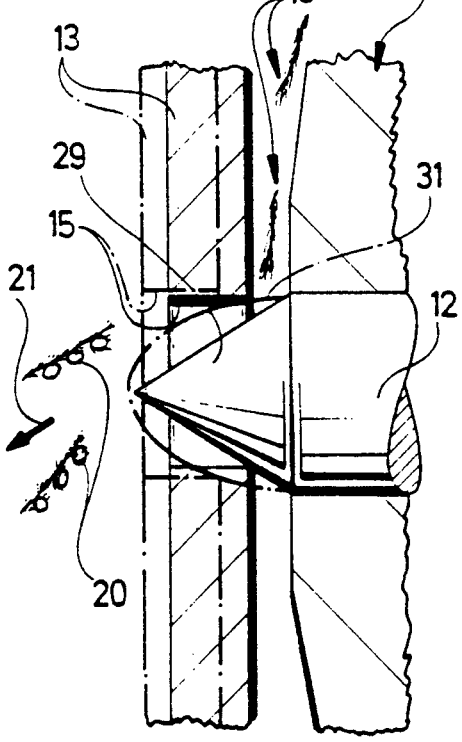

The following description of preferred embodiments serves in conjunction with the appended drawings to explain the invention in further detail. The drawings show:

FIG. 1 a guiding roller for threads according to the prior art;

FIG. 2 a guiding roller for threads which has been improved in accordance with the invention;

FIG. 3 two modified embodiments of the invention; and

Figure 4:
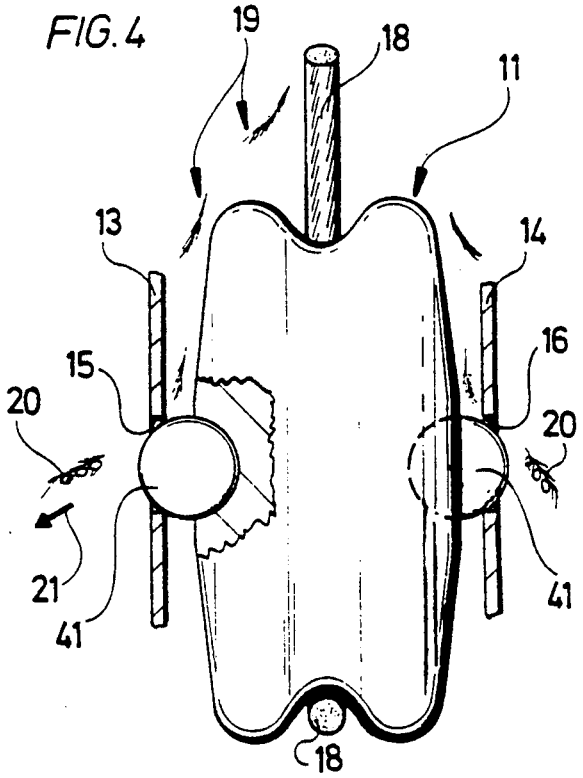

FIG. 4 a further modified embodiment of the invention.

FIG. 1 shows a thread guiding roller 1 of a kind known per se which is seated in a rotationally fixed manner on a shaft 2. The shaft 2 is rotatingly supported with its protruding ends in a holder formed by two bearing plates 3 and 4. For this purpose, the bearing plates 3, 4 contain corresponding recesses 5, 6 which receive the shaft ends without play. The guiding roller 1 has a circumferential groove 7 in which a thread 8 travelling to a textile machine, for example, an elastic synthetic thread, is guided. The guiding roller 1 is set in rotation by the thread 8 being supplied at a certain speed. As is evident from FIG. 1, the thread 8 is deflected through a certain angle, for example, 90°. The bearing recesses 5, 6 of the embodiment illustrated in FIG. 1 are not designed so as to go right through and so the ends of the shaft 2 do not protrude beyond the holder. In another embodiment known per se, the ends of the shaft 2 may also protrude beyond the bearing plates 3, 4, but these ends do not have any play in the recesses 5, 6 and these recesses are practically completely closed by the shaft ends.

The embodiment of a thread guiding roller 11 according to the invention illustrated in FIG. 2 differs from the prior art according to FIG. 1 essentially by the following features: The ends 9, 10 of the shaft 12 fixedly connected to the guiding roller 11 taper in the outward direction in semispherical configuration. The bearing plates 13, 14 serving as holder comprise bearing recesses 15, 16—for example, in the form of circular bores—-which in contrast with FIG. 1 are designed so as to go right through, i.e., penetrate the bearing plates 13, 14 completely. The spherically tapering ends 9, 10 of the shaft 12 penetrate the bearing recesses 15, 16, as is evident from FIG. 2, with play and protrude beyond these recesses 15, 16. The thread 18 which is to be supplied runs in the guide groove 17 of the guiding roller 11 in the same way as the thread 8 in the groove 7 according to FIG. 1.

Owing to the fact that the shaft 12 is supported with play with its tapering ends 9, 10 in the bearing recesses 15, 16, free openings are formed in the upper region of the recesses 15, 16 and open the space between the bearing plates 13, 14 and the side surfaces of the guiding roller 11 towards the outer side of the holder. During operation, the shaft 12 usually rests with its ends in the region of an edge of the bearing recesses 15, 16, and owing to the play mentioned hereinabove, the openings between bearing recesses 15, 16 and shaft 12 are formed at the edge regions respectively located opposite one another. As a rule, owing to gravity the shaft 12 will rest on the lower region of the bearing recesses 15, 16 and so the openings mentioned hereinabove will form in the upper region of these recesses. When the guiding roller 11 according to FIG. 2 is in operation, detached bits of fiber and other dust particles 19 originating, in particular, from the supplied thread 18 penetrate the space between the outer sides of the guiding roller 11 and the inner sides of the holder formed by the bearing plates 13, 14. These bits of fiber collect in the region of the shaft 12 and build up there in the known manner owing to the rotation of the shaft 12. On account of the tapering shaft ends 9, 10 which protrude beyond the bearing plates 13, 14 and owing to the play of the shaft 12 which produces the above-mentioned openings between the shaft 12 and the bearing recesses 15, 16, the build-up of bits of fiber and other dust particles is, however, constantly guided along the tapering shaft ends 9, 10 through the openings and out of the holder into the open. Hence jamming or even stopping of the guiding roller 11 cannot occur.

It was found that the detached bits of fiber and other dust particles which collect between the bearing plates 13, 14 and the outer sides of the guiding roller 11 in the region of the bearing recesses 15, 16 build up into compact pieces which are finally hurled off in the form of helical "sausages" 20 in the direction of arrows 21.

The side surfaces of the guiding roller 11 which extend away at an incline in a manner known per se from the inner sides of the bearing plates 13, 14 promote the compacting of the incoming detached bits of fiber or the like into the "sausages" 20 which then automatically emerge from the space between the shaft ends 9, 10 and the bearing recesses 15, 16. In this way, the gaps between the bearing plates 13, 14 and the side surfaces of the guiding roller 11 which taper towards the shaft ends 9, 10 act as a funnel.

The two modified embodiments of guiding rollers according to the invention illustrated partly in FIG. 3 act in the same way as the embodiment according to FIG. 2 and differ from the latter only in the different design of the shaft end.

As indicated by continuous lines in FIG. 3, the end 29 of the shaft 12 is of conical configuration and tapers towards a tip.

In the embodiment illustrated in dot-and-dash lines in FIG. 3, the shaft end 31 tapers outwards in the form of an oval.

In FIG. 3, only one respective end of the shaft 12 is illustrated. The respective other end of the shaft 12 is of the same design.

In particular, the space between the shaft ends 29, 31 and the bearing recess 15 through which compacted fibrous fluff or the like ("sausages" 20) is conveyed away is again evident in FIG. 3.

It is also clearly evident from FIG. 3 how the tapering end 29, 31 of the shaft 12 rests on the bottom edge of the bearing recess 15.

The embodiment according to FIG. 4 differs in design from the embodiments described so far in that instead of a continuous shaft, balls 41 are attached on both sides of the guiding roller 11 for rotatingly supporting the guiding roller 11 in the bearing recesses 15 and 16. Hence the balls 41 assume the function of the shaft ends 9, 10 in FIG. 2.

The diameter of the bearing recesses 15, 16 which are preferably in the form of round bores is smaller than the diameter of the shaft 12 and the balls 41, respectively. It is only decisive that the tapering end of the shaft 12 should be supported in the bearing recess 15, 16 in such a way that on account of the play, an opening is created for the continuous passage of the compacted fibrous fluff.

In an embodiment of the invention which has been tried out in practice, the shafts 12 and the balls 41, respectively, had a diameter of 4 mm. The diameter of the bearing bore was 3 mm. The spherical ends of the shaft dipped so far into the bearing recesses 15, 16 that owing to the play, an opening of approximately 0.2 mm height was created between the shaft end and the bearing recess. In general, it is expedient for the play of the tapering shaft ends 9, 10, 29, 31, 41 in the bearing recesses 15, 16 to lie between a tenth and a twentieth, preferably at approximately a fifteenth of the diameter of the bearing recess 15, 16.

The effect described hereinabove, namely the continuous passage of the fibrous fluff which has been twisted into "sausages" through the openings between the shaft ends and the bearing recesses can be reinforced by take-along elements for the detached bits of fiber or the like being arranged or formed on the side surfaces of the guiding roller 11, for example, in the form of roughenings of these surfaces or helical grooves, by the formation of shovel-like members or by the arrangement of knife-like elements which promote conveyance of the fibrous fluff.

The present disclosure relates to the subject matter disclosed in German application No. P 40 18 497.8 of Jun. 9, 1990, the entire specification of which is incorporated herein by reference.

what is claimed is:

1. A roller assembly for guiding a textile thread including in combination a roller having a peripheral guide groove for receiving the thread, a shaft carrying said roller, said shaft having ends tapering outwardly from sides of said roller, and respective holders for supporting the tapering ends of said shaft, each of said holders being formed with a bearing recess having edges and extending therethrough for receiving one of the tapering shaft ends with play and with the shaft end protruding beyond said bearing recess, the tapering shaft ends resting in a region of said edges of the bearing recesses and, owing to the play, free openings being formed between the bearing recesses and the tapering shaft ends in a region opposite to the edge region whereby any buildup in the region of said shaft of bits of fiber from said thread is guided by said tapered shaft ends through and out of said free openings.

2. Guiding roller as defined in claim 1, characterized in that said ends (9, 10) of said shaft (12) are of spherical design.

3. Guiding roller as defined in claim 2, characterized in that two balls (41) which are fixedly connected to said guiding roller (11) and protrude on either side of said guiding roller (11) are provided as shaft.

4. Guiding roller as defined in claim 1, characterized in that said ends (29) of said shaft (12) are of conical design.

5. Guiding roller as defined in claim 1, characterized in that said ends (29) of said shaft (12) are of oval design.

6. Guiding roller as defined in claim 1, characterized in that each of said holders is designed as a bearing plate (13, 14) and each of said bearing openings (15, 16) as a circular bearing bore.

7. Guiding roller as defined in claim 1, characterized in that the play of said tapering shaft ends (9, 10, 29, 31, 41) in said bearing openings (15, 16) lies between a tenth and a twentieth of the diameter of said bearing openings (15, 16).

8. A roller assembly as in claim 1 characterized in that said roller has side surfaces which are inclined away from said supports to produce gaps between the side surfaces and the supports which taper towards said shaft ends.

* * * * *